United States Patent [19]

Culbertson et al.

[11] 4,380,321

[45] Apr. 19, 1983

[54] COLOR CHANGE VALVE STRUCTURE FOR ROTARY HEAD ELECTROSTATIC SPRAY COATING SYSTEMS

[75] Inventors: Samuel W. Culbertson, Arvada; Charles W. McCulloch, Westminster; Keith G. Williams, Boulder, all of Colo.

[73] Assignee: Binks Manufacturing Company, Franklin Park, Ill.

[21] Appl. No.: 228,365

[22] Filed: Jan. 26, 1981

[51] Int. Cl.[3] ..... B05B 5/00

[52] U.S. Cl. ..... 239/700; 239/110; 239/112

[58] Field of Search ..... 239/106, 110, 112, 700

[56] References Cited

U.S. PATENT DOCUMENTS

| | | | |
|---|---|---|---|
| 3,121,024 | 2/1964 | Wamples | 239/110 X |
| 3,857,513 | 12/1974 | Wiggins | 239/112 X |
| 3,870,233 | 3/1975 | Wilhelm et al. | 239/112 X |

*Primary Examiner*—John J. Love
*Assistant Examiner*—Paul A. Sobel
*Attorney, Agent, or Firm*—Gary, Juettner & Pyle

[57] ABSTRACT

A color change valve structure for rotary head electrostatic spray coating systems, of the type to which a rapid rotation is imparted to a rotary spray head and coating material directed through an orifice against the head for discharge from a peripheral edge of the head in a spray, is characterized by coating material and dump valves behind the head in close proximity with the orifice. The coating material valve controls a flow of coating material from a supply line to the orifice, and the dump valve is operable to establish a passage from the supply line, through the material valve and to a dump outlet. To purge the system of coating material of one color in preparation for spraying material of another, the material valve is closed, the dump valve is opened and a flow of flushing media is established through the supply line, whereby the flushing media cleanses the supply line and material valve. Thereafter, the dump valve is closed and the material valve momentarily opened to cleanse the passage between the material valve and orifice, whereupon the system is prepared to spray coating material of another color. The arrangement of the valves enables rapid and thorough flushing of the system, and the close proximity of the material valve to the orifice minimizes the quantity of coating material and flushing media impinged on the head during color changes processes.

3 Claims, 4 Drawing Figures

COLOR CHANGE VALVE STRUCTURE FOR ROTARY HEAD ELECTROSTATIC SPRAY COATING SYSTEMS

BACKGROUND OF THE INVENTION

The present invention relates to color change systems for spray coating apparatus, and in particular to a color change valve structure for use with a rotary head electrostatic spray coating system, which enables the system to be rapidly and thoroughly cleansed of coating material of one color in preparation for spraying coating material of another color.

Electrostatic spray coating systems have been successfully used in commerce in several different forms. For example, systems have been used in which spraying or atomizing devices employ hydraulic forces or air as the atomizing medium, and means are provided for electrostatically charging the spray particles for attraction to articles or ware to be coated. In another type of system, and with which the present invention is particularly suited for use, atomization is accomplished by means of a centrifugal sprayer member or head to which a rapid rotation is imparted. The head has a surface against which a stream or jet of liquid to be sprayed is directed through an orifice, the liquid on striking the revolving surface progressing radially outwardly thereover in a thin film under centrifugal force toward a sharp annular peripheral edge of the head, whereat it is divided into fine particles so that it leaves the periphery in the form of a spray. For electrostatic deposition of coating material the rotary head is made of a conductive material and connected to a high d.c. potential, so that the spray particles on moving past the peripheral edge of the head are charged to a high electrostatic potential. The resulting ionized or electrostatically charged cloud of particles is then attracted to and settles on the surface of articles to be coated, which are maintained at a different and usually ground potential.

In use of such electrostatic spray coating systems, it often happens that articles are required to be coated a wide variety of colors. In such a case, it is generally not practical to establish separate spray stations or production lines for each color, or even to spray a long sequence of articles of one color, then another long sequence of articles of a second color, etc. Instead, it is desirable to be able to make color changes rapidly and simply at a single spray station.

Color change systems are useful in such cases, and enable a variety of colors to be sprayed from a single spray coating apparatus. In one conventional color changer, for example, a plurality of supply containers of coating material, each of a different color and having a separate motor driven fluid pump, are connected with a manifold through valve controlled ports. An outlet from the manifold connects through a supply line with an inlet to the spray coating apparatus, and to spray material of a particular color the port valve associated therewith is opened and the motor driven pump for the supply is energized to provide the fluid through the manifold and supply line to the spray coating apparatus inlet, and thence to the orifice for impingement against the rotary head. After completion of spraying coating material of a particular color, the manifold, supply line and spray coating apparatus are cleansed with flushing media to prepare the same for spraying material of a different color.

Preparing conventional electrostatic spray coating systems to spray a new color of coating material has heretofore involved a rather exacting process, primarily because the entirety of the supply line and the spray coating apparatus must be cleansed of material. To accomplish the same, flushing media is introduced through the supply line, and with conventional spraying apparatus the entirety of the flushing media is discharged through the orifice and against the rotary head. Consequently, not only is the flow rate of the flushing media restricted to the extent that it must pass through the orifice, but also the flushing media is emitted from the head in a spray, and some means must be provided to prevent it from freely entering and polluting the atmosphere and depositing on articles. One such means contemplated by the prior art is to place an enclosure around the rotary head during a color change operation, and another to move the entirety of the spray coating apparatus to a position whereat the sprayed flushing media may be properly contained. In either case, the color change process is complex and time consuming.

OBJECTS OF THE INVENTION

An object of the present invention is to provide a color change valve structure for a rotary head electrostatic spray atomizing system, which enables the system to be quickly, thoroughly and conveniently cleansed of coating material of one color in preparation for spraying coating material of another color.

Another object of the invention is to provide such a color change valve structure, which is arranged to minimize the quantity of coating material and flushing media sprayed from the head during a color change process.

SUMMARY OF THE INVENTION

In accordance with the present invention, there is provided in combination a rotary head electrostatic spray coating apparatus and a color change valve structure for the apparatus. The spray coating apparatus comprises a body, a rotary head at a forward end of said body, means for imparting a rapid rotation to said head, and means for directing a jet of coating material against said head for discharge from a peripheral edge thereof in a spray. Said body has an inlet for connection through a line with either a supply of coating material of a selected color or a supply of flush for the coating material, an outlet and a passage between said inlet and a position in proximity with said head for conveying from said inlet coating material to be directed against said head. Said color change valve structure comprises valve means in said body for controlling a path through said passage and for connecting and disconnecting said inlet with and from said outlet, and means for operating said valve means. Said means for operating said valve means establishes a path through said passage and disconnects said inlet from said outlet when said inlet is connected through the line with a supply of coating material of one color, so that coating material of the one color flows through the line and said passage for being directed against said head. Said means for operating said valve means also interrupts the path through said passage and connects said inlet with said outlet when said inlet is connected through the line with a supply of flush, so that flush then flows through the line and from said inlet to said outlet to cleanse the same in preparation for connecting said inlet with a supply of coating material of another color.

Preferably, said valve means comprises a material valve for controlling the path through said passage, and a dump valve for connecting and disconnecting said inlet with and from said outlet. Since coating material also flows through said passage for being directed against said head, said means for operating said valve means also operates said material valve, when said inlet is connected through the line with the supply of flush, to momentarily establish a path through said passage to cleanse said passage of coating material of the one color in preparation for receiving therein coating material of the other color. Thus, the particular structure of the invention facilitates cleansing the spary coating apparatus when the same is used in connection with a color change system, such that the apparatus may be quickly and conveniently cleansed during color change operations.

The foregoing and other objects, advantages and features of the invention will become apparent upon a consideration of the following detailed description, when taken in conjunction with the accompanying drawings.

DETAILED DESCRIPTION

Figure 1:
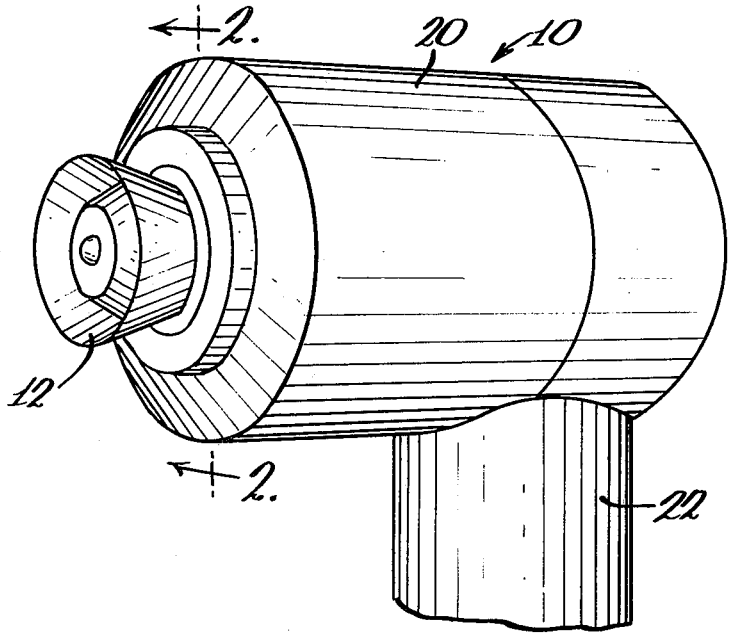
FIG. 1 is a perspective view of a portion of a rotary head electrostatic spray coating system of a type which a color change valve structure embodying the teachings of the present invention may advantageously be used.
Figure 2:
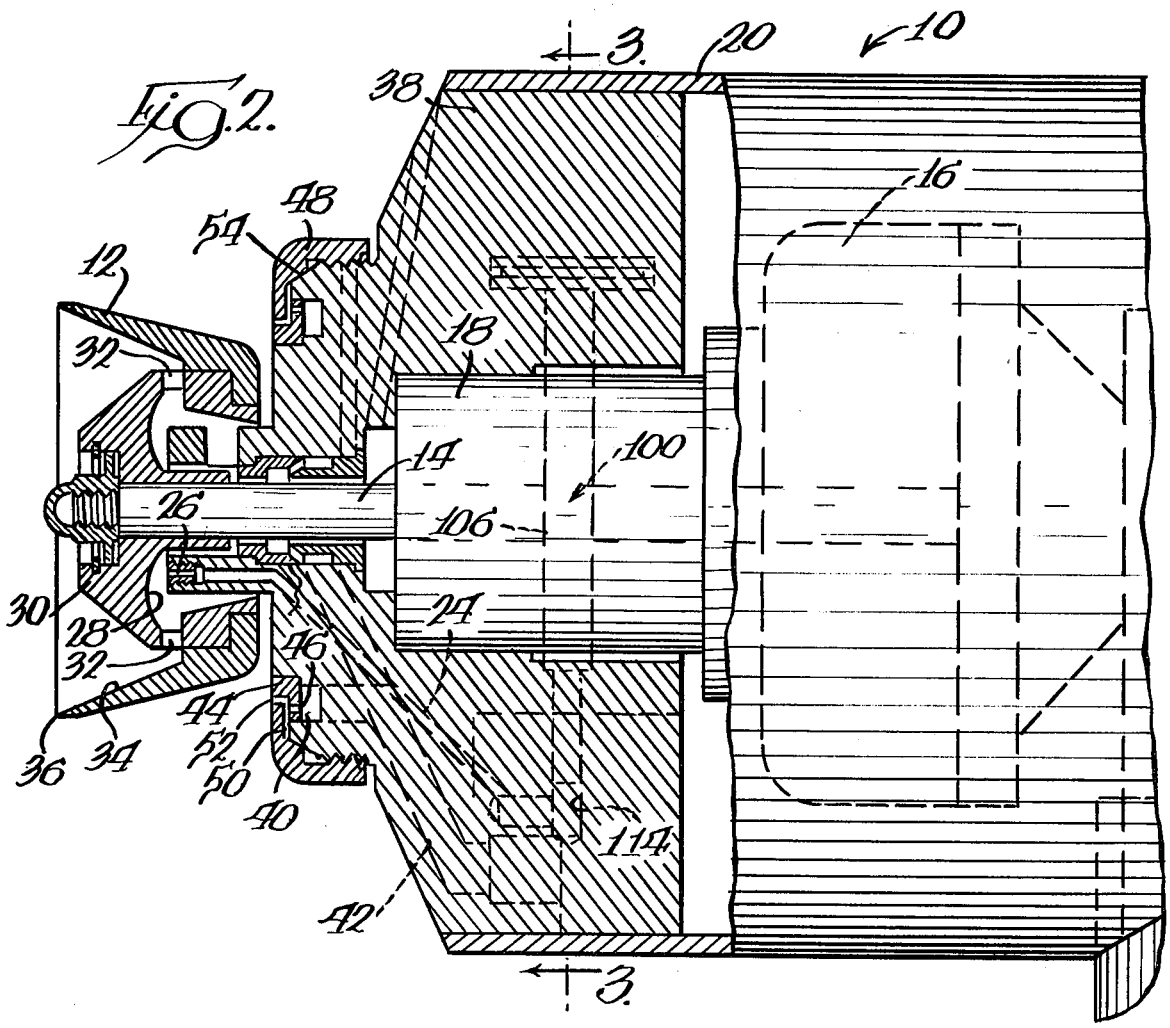
FIG. 2 is a cross sectional elevation view taken substantially along the lines 2—2 of FIG. 1, and illustrates the forward portion of the rotary head electrostatic spray coating system and one of the valves of the color change valve structure.

Referring to the drawings, there is shown in FIGS. 1 and 2 and indicated generally at 10 a rotary head electrostatic spray coating system, which includes a rotatable, bell-shaped head 12 of conductive material, mounted on an output shaft 14 of a high speed air driven turbine 16. The output shaft is journaled in a bearing 18, and the turbine rotates the head at a high rate of speed on the order of 30,000 to 60,000 rpm. The turbine is contained within an outer housing or casing 20, and the housing is supported on an end of an arm 22 of insulating material, an opposite end of the arm being connected to any suitable mechanism (not shown) for moving the apparatus to positions permitting proper deposition of coating material on articles, for example on articles moved past the apparatus on a conveyor.

In operation of the spray coating apparatus 10, coating material in a passage 24 passes through an orifice 26 and is directed in a stream or jet onto an interior surface 28 of a center portion 30 of the head 12. Because of rotation of the head, upon striking the surface 28 the coating material progresses radially outwardly through passages 32 and across an inner wall 34 of the head in a thin film under centrifugal force toward a sharp, circular, peripheral edge 36 of the head, whereat it is divided as it leaves the head into fine particles in the form of a spray. A high d.c. voltage which may be on the order of 120,000 volts is connected with the head, so that spray particles on moving past the peripheral edge are charged to a high electrostatic potential for attraction to articles to be coated, which are maintained at a different and usually ground potential. To this end, the insulating material support arm 22 isolates peripheral equipment from high voltages present at the spray assembly.

Although improvements are obtained in coating material deposition by virtue of electrostatic attraction of the spray particles to the ware, if electrostatic attraction were the sole means for moving the spray to the ware a significant amount of the spray would not reach the ware. This may be appreciated if it is considered that at the very high speed of rotation of the head 14, spray particles discharged from the peripheral edge thereof travel at significant velocities in directions generally radially of the head and parallel to the articles, since articles to be coated are usually positioned forwardly of the head along its axis of rotation. Thus, the direction of movement of the spray particles must be changed by up to 90° and more for the particles to reach the ware, which can hardly be accomplished with electrostatic forces alone. Consequently, additional means is provided for aiding movement of the spray toward the ware.

To aid movement of spray particles toward ware to be coated, the art contemplates generating a shroud or curtain of air for movement over, around and forwardly of the head and against the particles as they leave the peripheral edge of the head. To this end, the spray coating apparatus 10 includes a shroud air generating structure on a front face of a forward body portion 38 of the apparatus, which includes an annular channel 40 formed in the front face and having a diameter sufficient to extend beyond the rearward end of the rotary head 12. A supply of air (not shown) under pressure connects with the channel through an air inlet passage 42, and an annular air diffuser ring 44, having a plurality of passages 46 therethrough in an annular array therearound, closes the forward side of the channel, preferably by being press fit therein. An annular shroud air cover 48 is threaded onto the forward end of the body portion, and defines with the air diffuser ring an annular chamber 50 in communication with the passages 46 and an annular shroud air outlet passage 52 in communication with the chamber. When the cover 46 is mounted on the body portion 38 a seal is formed therebetween as at 54, whereby air introduced into the passage 42 enters the channel 40, passes into the chamber 50 through the passages 46, and exits from the chamber through the annular shroud air outlet opening 52 for movement in a uniform, annular curtain over, around and forwardly of the rotary head 12 and against the spray particles to aid in moving the same toward articles to be coated.

The spray coating apparatus 10 thus far described may be used to spray only one color of coating material. However, in most commercial applications the apparatus will be required to spray a wide variety of colors, and for the purpose a color change system (not shown) will be associated therewith. The color change may be of any conventional type, such for example as the type in which a plurality of supply containers of coating material, each of a different color and having a separate motor driven fluid pump, are connected with a manifold of the color changer through valve controlled ports. An outlet from the manifold would connect with a coating material inlet passage to the apparatus 10 through a supply line (not shown), and to spray material of a particular color the port valve associated therewith would be opened and the motor driven pump for the supply energized to provide the material through the manifold and supply line to the apparatus 10 for movement through the material passage 24 and the orifice 26 for impingement on the rotary head 12. After completion of spraying material of a particular color, a flushing media would be used to clean the manifold, and would be introduced through the supply line and coating apparatus to clean the same, in preparation for spraying material of a different color.

Without more and as is conventional, during color changes the flushing media, which usually comprises alternate applications of a solvent for the coating material and compressed air, would move through the passage 24 and orifice 26, impinge on the rotary head 12 and be emitted from the head in a spray. Not only is solvent an undesirable contaminant in the atmosphere, but also significant amounts of it cannot be permitted to deposit on the articles. Consequently, during color changes it is usual practice to move the spray apparatus to a location whereat the flushing media may be safely sprayed and collected. Obviously, since the entirety of the supply line to the apparatus, as well as the coating material passages in the apparatus, must be cleansed during color changes, a considerable quantity of flushing media is sprayed, and since the flushing media flow is restricted by the orifice 26, a significant period of time is required to move through the system a quantity of flushing media which is sufficient to properly clean the system.

In overcoming the aforementioned disadvantages associated with changing color of material sprayed, the present invention provides a color change valve structure which enables changes to be rapidly and conveniently made in the colors of materials sprayed, and at the same time significantly minimizes the quantity of flushing media during color changing. More particularly, and referring also to FIG. 3, the color change valve structure includes a material valve and a dump valve, indicated respectively at 100 and 102, mounted in the forward body portion 38 of the spray apparatus. The material valve operates to establish and interrupt a path between a coating material or fluid inlet 104 to the apparatus, which connects with a material supply line from a color changer, and an end of the passage 24 opposite from the orifice 26, and includes a piston rod 106 reciprocable in a sleeve 108 threaded into an end of a chamber 110 in the body portion 38. The end of the rod within the chamber has a reduced diameter and defines a valve 112, and the end of the passage 24 communicates with a valve seat 114 in the body portion. A passage 116 connects the inlet with the chamber, so that reciprocation of the piston rod moves the valve 112 into and out of the valve seat to interrupt and establish a path between the inlet 104 and the passage 24 through the chamber 110.

To reciprocate the piston rod 106 to operate the material valve 100, the material valve also includes motor means, which as shown comprises a piston 118 at an opposite end of the rod, received in a cylinder 120 threaded into a chamber 122 in the body portion 38. Opposite from the cylinder the rod is reciprocable in a sleeve 24, and a spring 126 is under compression between an annular washer 127 on the rod and the sleeve to normally urge the rod in the direction to close the valve. To move the rod in the direction opening the valve, an air inlet 128 communicates with the chamber 122 on one side of the piston, such that application of air under pressure at the inlet moves the piston against the urging of the spring to open the valve.

The dump valve 102 has a structure similar to that of the material valve 100, and includes a piston rod 130 reciprocable in a sleeve 131 threaded into an end of a chamber 132 in the body portion 38. The end of the rod in the chamber has a reduced diameter and defines a valve 133 adapted to move into and out of a valve seat 134 upon reciprocation of the rod. A dump outlet passage 136 communicates with the valve seat, whereby movement of the valve into and out of the valve seat interrupts and establishes a path between the dump outlet and the chamber 132.

To reciprocate the piston rod 130 to open and close the dump valve 102, the dump valve also includes a motor means, which as shown comprises an air cylinder having a piston 138 at an end of the rod, received in a cylinder 140 threaded into an end of a chamber 142 in the body portion 38. The rod is reciprocable in a sleeve 144 at an opposite end of the chamber, and a spring 146 under compression between the sleeve and a washer 148 on the rod normally urges the rod in a direction to close the valve. To open the valve an air inlet 148 is in communication with the chamber 142 on one side of the piston, so that application of air under pressure at the inlet moves the piston in the direction opening the valve. Obviously, any suitable manual or automatic control means may be used to control application of air at the material and dump valve motor means air inlets 128 and 148, and a passage 150 connects the chamber 110 of the material valve 100 and the chamber 134 of the dump valve 102.

Figure 3:
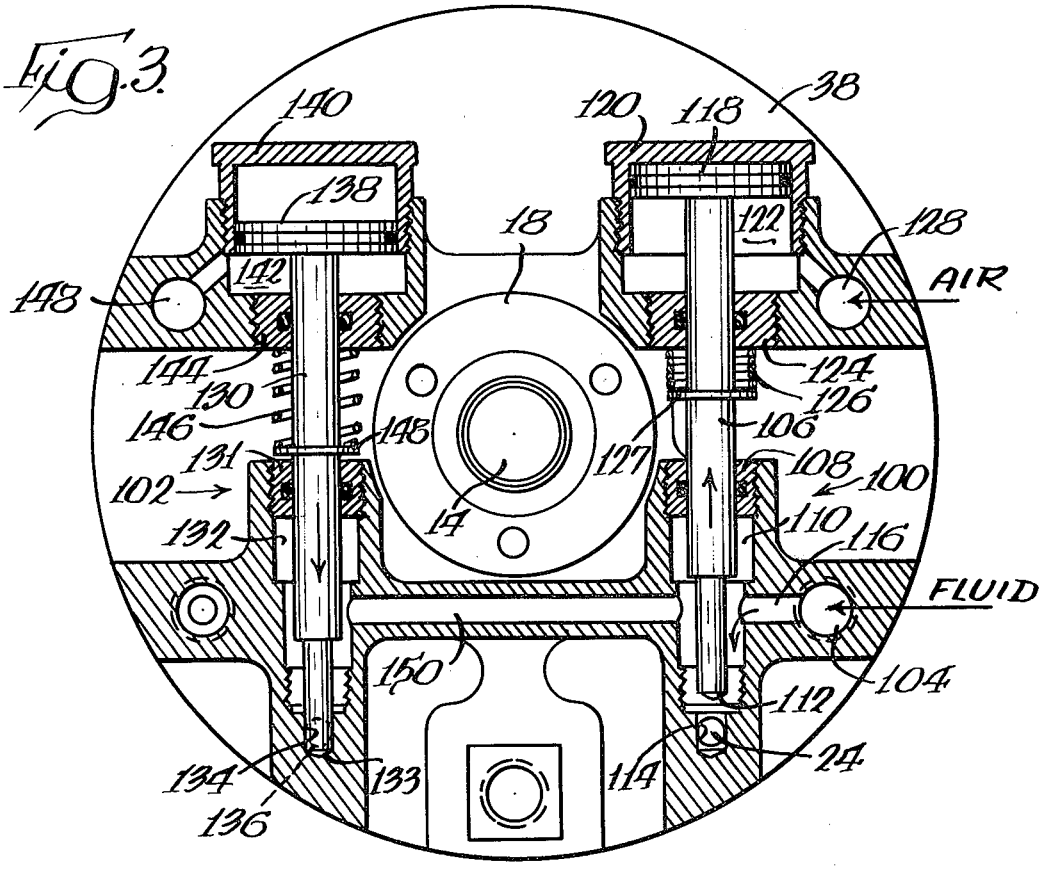
FIG. 3 is a cross sectional front elevation view taken substantially along the lines 3—3 of FIG. 2, and shows the color change valve structure of the invention in its operative state for delivering coating material to the rotary head of the spray coating apparatus.

Turning now to operation of the color change valve structure, FIG. 3 shows the states of the material and dump valves 100 and 102 when coating material is being supplied to and sprayed from the rotary head 12. Under this condition, air under pressure is applied to the inlet 128 to open the material valve 100, but not to the inlet 148, so that the dump valve 102 is closed. Thus, coating material at the inlet 104 from the supply line flows through the pasage 116 and the chamber 110 to the valve seat 114, from whence it moves through the passage 24 to the orifice 26 for impingement on the rotary head, but does not flow through the passage 150.

Upon completion of spraying coating material of one color, the material delivery system, which includes the color changer, the supply line and the entirety of the coating material passage portions of the apparatus 10, must be cleansed to prevent contamination of the next material to be sprayed. The particular means by which the color changer is cleaned depends upon the particular type of color changer used, and is not relevant to the present invention. However, it is necessary that the color changer be capable of supplying flushing media through the supply line, or that other means be provided to do so, whereby either simultaneously with or subsequent to color changer cleaning the supply line and material passages of the spray apparatus may be flushed clean of coating material, and the novel color change valve structure of the invention enables such a cleaning to be rapidly and conveniently accomplished.

Figure 4:
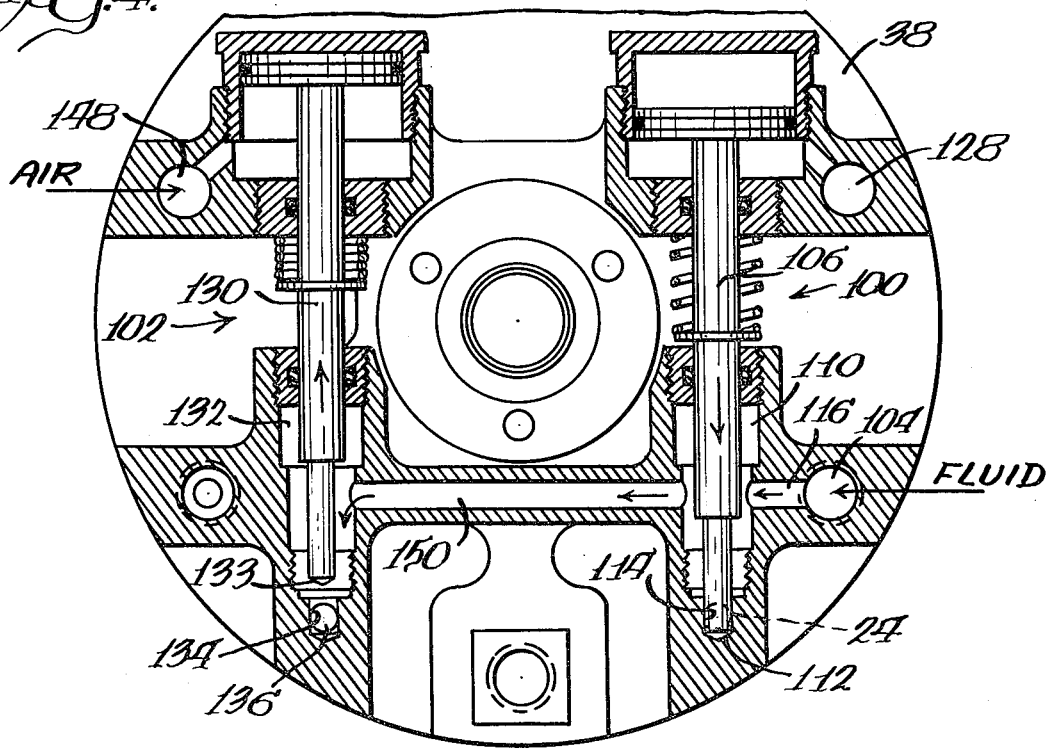
FIG. 4 is similar to FIG. 3, but shows the valve structure in its operative state during a color change process.

FIG. 4 shows the operational states of the material and dump valves 100 and 102 during system flushing. As is seen, air under pressure has been removed from the inlet 128, so that the material valve 100 is now closed, but has been applied to the inlet 148 to open the dump valve and expose the dump outlet 136. With the valves in the states shown, flushing media is applied through the supply line to the inlet 104. Since the material valve is closed and the dump valve open, the flushing media is prevented from entering the passage 24, but instead, flows through the passage 116, the chamber 110, the passage 150 and the chamber 132 to the dump outlet 136, cleansing the surfaces thereof as well as the portions of the piston rods 106 and 130 within the chambers 110 and 132. The dump outlet presents a relatively large flow area as compared with the orifice 26, so that compared to conventional spray coating systems, wherein flushing media is exhausted through the orifice and impinged on the rotary head, an increased flow rate of flushing media is accommodated for rapid and thorough cleansing of the system. At the same time, the flushing media exiting the outlet may conveniently be collected for recycling.

Upon completion of flushing the coating material supply line and the described portions of the material and dump valves 100 and 102, a very small amount of coating material remains in the passage 24. Consequently, and while flushing media is still applied at the inlet 104, the material valve 100 is momentarily opened to admit a small quantity of flushing media into the passage to cleanse the passage and the orifice 26. The passage is of relatively small volume, so that only a small quantity of flushing media is required to cleanse the same, and therefore only a small quantity of flushing media is sprayed. Although some means may be provided to collect the sprayed flushing media to prevent its introduction into the atmosphere or deposition on articles, because of the small quantity involved it is often not necessary to provide any such means. Thereafter, and usually following application of air only at the fluid inlet to remove any residual solvent from the system, the dump valve 102 is closed and the material valve 100 is opened, as shown in FIG. 3, in preparation for spraying the next succeeding color of coating material.

The invention thus provides a color change valve structure for rotary head electrostatic spray coating systems, which enables changes in colors of coating materials sprayed to be rapidly and conveniently made. By virtue of the relatively large flow area of the outlet from the dump valve, as compared with the relatively restricted opening through the orifice 26, increased flow rates of flushing media are accommodated to quickly and thoroughly cleanse the system. At the same time, because the material valve connects with the passage 24 closely adjacent to the orifice 26, and because of the small size of the passage, only a very small quantity of coating material need be flushed therefrom, so that only a very small quantity of flushing media need be emitted in a spray during flushing.

While one embodiment of the invention has been described in detail, various modifications and other embodiments thereof may be devised by one skilled in the art without departing from the spirit and scope of the invention, as defined in the appended claims.

What is claimed is:

1. In combination, rotary head electrostatic spray coating apparatus comprising a generally cylindrical body, a rotary spray head at a forward end of said body, means for imparting a rapid rotation to said spray head, nozzle means for directing a jet of coating material against said head for discharge from a peripheral edge thereof in a spray, an inlet to said body for connection through a line with either a supply of coating material of a selected color or a supply of flush for the coating material, an outlet from said body, a passage in said body between said inlet, said outlet and said nozzle means, and a color change valve structure comprising valve means contained entirely in said body and in said passage substantially immediately behind said spray head for controlling paths through said passage and for connecting and disconnecting said inlet with and from said outlet and said nozzle means, and means for operating said valve means to establish a path through said passage between said inlet and said nozzle means and to interrupt a path through said passage between said inlet and said outlet when said inlet is connected through the line with a supply of coating material of one color, so that coating material of the one color flows through the line and said passage to said nozzle means for being directed against said spray head, and to interrupt the path through said passage between said inlet and said nozzle means and to establish a path through said passage between said inlet with said outlet when said inlet is connected through the line with the supply of flush, so that flush flows through the line and from said inlet to said outlet through said passage to cleanse the same in preparation for connecting said inlet with a supply of coating material of another color, wherein said passage has a first enlarged chamber separating said passage into a first passage section between said inlet and said first chamber and a second passage section between said first chamber and said nozzle means, said second passage section forming a first valve seat whereat it communicates with said nozzle means, and a second enlarged chamber separating said passage into a third passage section between said first and second chambers and a fourth passage section between said second chamber and said outlet, said fourth passage section forming a second valve seat whereat it communicates with said outlet, said valve means comprising a material valve for controlling a path through said passage between said inlet and said nozzle means and a dump valve for controlling a path through said passage between said inlet and said outlet, said material valve including an elongate rod extending through said first chamber and reciprocable therein, one end of said rod forming a valve for movement against and away from said first valve seat upon reciprocation of said rod, said dump valve including an elongate rod extending through said second chamber and reciprocable therein, one end of said rod forming a valve for movement against and away from said second valve seat upon reciprocation of said rod, said valve operating means, when said inlet is connected with a supply of coating material through the line, operating said material and dump valves to move said material valve rod away from said first valve seat and to move said dump valve rod against said second valve seat, whereby coating material flows through the line to said inlet and from said inlet through said first passage section, said first chamber and said second passage section to said nozzle means for being directed against said spray head, but does not flow through said third passage section, said second chamber and said fourth passage section to said outlet, and so that when said inlet is connected through the line with the supply of flush said valve operating means operates said material and dump valves to move said material valve rod against said first valve seat and said dump valve rod away from said second valve seat, whereby flush flows through the line to said inlet and from said inlet through said first passage section, said first chamber, said third passage section, said second chamber and said fourth passage section to said outlet to cleanse the same of coating material, but does not flow through said second passage section to said nozzle means.

2. The combination as in claim 1, wherein said means for operating said valve means includes a pair of cylinders each having an air operated piston therein connected with an opposite end of a respective one of said material and dump valve rods for reciprocating the same.

3. The combination as in claim 2, wherein said material and dump valve rods and their associated cylinders extend perpendicular to the axis of rotation of said rotary head for a decreased length of said cylindrical body.

* * * * *